United States Patent [19]

Ziecker

[11] 4,223,509

[45] Sep. 23, 1980

[54] FILM TUCKING PACKAGING MACHINE

[75] Inventor: Roger A. Ziecker, Lawrenceville, Ga.

[73] Assignee: The Mead Corporation, Dayton, Ohio

[21] Appl. No.: 36,778

[22] Filed: May 7, 1979

[51] Int. Cl.[3] ..... B65B 11/10

[52] U.S. Cl. ..... 53/209; 53/228; 53/233

[58] Field of Search ..... 53/586, 209, 210, 228, 53/229, 232, 233

[56] References Cited

U.S. PATENT DOCUMENTS

| | | | |
|---|---|---|---|
| Re. 28,535 | 9/1975 | Ganz | 53/210 X |
| 2,810,246 | 10/1957 | Copnock et al. | 53/210 |
| 2,918,772 | 12/1959 | Beu | 53/388 |
| 4,134,246 | 1/1979 | Michels | 53/210 X |

*Primary Examiner*—John Sipos

*Attorney, Agent, or Firm*—Rodgers & Rodgers

[57] ABSTRACT

A package preferably of cube shape is supported and moved by a series of notched rollers (5–9) and a film (F) is disposed in overlying relation to the package with its leading part (FL) underneath the leading part of the package and a movable tucking bar (23) is arranged to move into engagement with the trailing part (FT) of the film and movable in sequence through the notches (11, 25, 27, 29, 31) in the rollers so as to tuck the trailing part (FT) of the film (F) underneath the trailing part of the package and in overlapping relation with respect to the leading part (FL) of the film (F).

10 Claims, 1 Drawing Figure

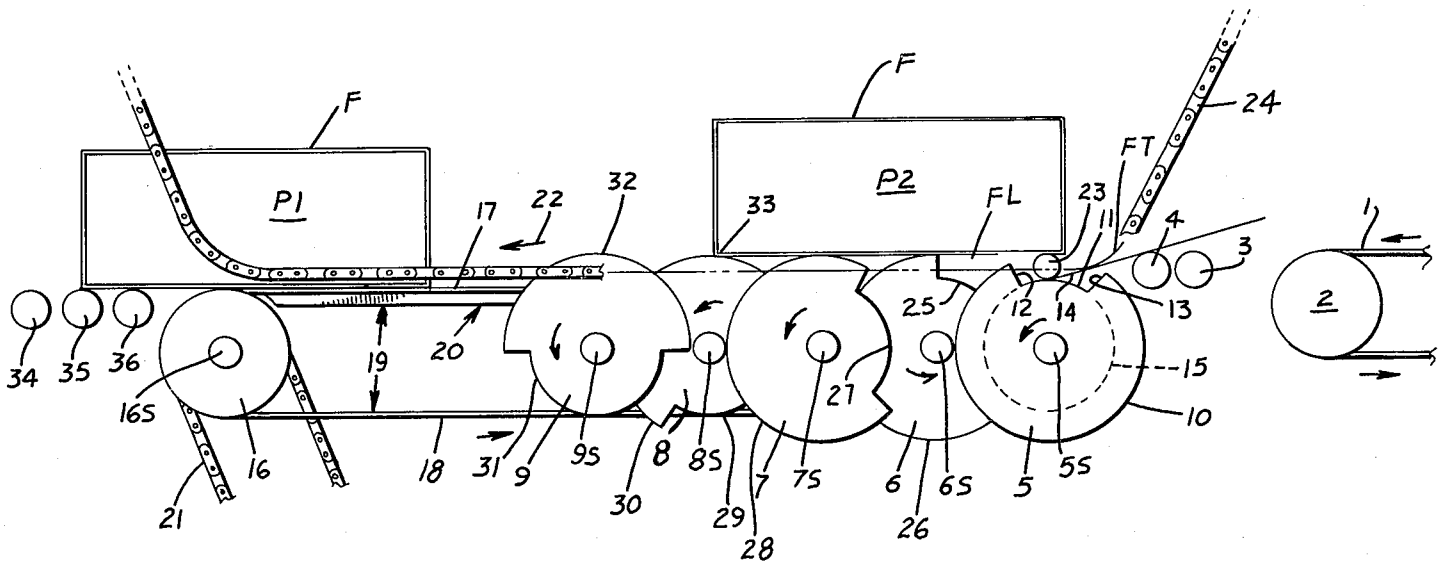
1
2
24
3
4
13
15
10
FT
11
23
14
12
55
5
FL
25
65
26
6
F
P2
21
75
7
28
29
33
85
8
30
32
95
9
22
31
17
20
18
19
F
P1
16
21
36
165
35
34

FILM TUCKING PACKAGING MACHINE

TECHNICAL FIELD

This invention relates to a packaging machine for wrapping containers of random size with a film such as polyethylene.

BACKGROUND ART

U.S. Pat. No. 2,918,722 Bell et al and U.S. Pat. No. 3,660,961 Ganz disclose machines in which forward tucking of a trailing film is disclosed. Such prior art devices generally are not well adapted for high speed packaging operations and also are not characterized by a high degree of precision with respect to the cooperation of associated parts.

DISCLOSURE OF INVENTION

According to this invention in one form, a high speed film wrapping machine which is characterized by synchronously movable parts includes a series of notched rollers each of which comprises a pair of spaced coaxial parts between which a conveyor is mounted at a level below the peripheral paths inscribed by the unnotched portions of the rollers so that a package which preferably is in the form of a cube and which is mounted on the rotatable rollers and moved thereby may readily be enveloped by a wrapping film which initially is disposed in overlying relation with respect to the package and with its leading end disposed underneath the leading part of the package and wherein a movable tucking bar approaches the trailing part of the film from the rear and which moves at a velocity in excess of the velocity of movement of the package and therefore passes underneath the package while occupying sequential positions in notched portions of the rollers so that the trailing part of the film is tucked underneath the trailing part of the package in overlapping relationship with respect to the leading part of the film.

BRIEF DESCRIPTION OF DRAWING

The single view of the drawing simply constitutes a schematic side view of a packaging machine constructed according to the invention.

BEST MODE OF CARRYING OUT THE INVENTION

In the drawing a completed package is designated at P1 and a package which is in the process of being wrapped with film F is designated at P2. The leading part of the film is designated FL and obviously underlies the leading part of package P2. The trailing part of the film is designated at FT and is shown in connection with package P2 in the process of being tucked underneath the trailing part of package P2.

Package P2 is supplied to the infeed end of the machine on a conveyor designated by the numeral 1 which envelopes at one end the leading roll 2. The package moves off of conveyor 1 onto rolls 3 and 4 and from these rolls onto the notched rolls 5, 6, 7, 8, and 9. Roll 5 is constructed with an unnotched peripheral part 10 and with a notched part 11. Notch 11 extends from shoulder 12 to shoulder 13 and the peripheral portion 14 of the notch 11 is approximately the same diameter as the roll 15 shown in dotted lines in the drawing. This roll 15 in conjunction with a similar roll 16 supports the working reach 17 and the return reach 18 of a conveyor 19 having a support plate 20. Operating movement is imparted to conveyor 19 by chain 21 which cooperates with a sprocket (not shown) associated with roll 16 so that the working reach 17 of the conveyor 19 moves from right to left as indicated by the arrow 22.

For the purpose of tucking the trailing end FT of film F underneath the trailing part of package P2, a tucking bar 23 is mounted at its ends on a pair of spaced apart chains only one of which is observable in the drawing and which is indicated by the numeral 24. Thus as the tucking bar 23 moves downwardly and to the left to occupy the position shown in the drawing, the trailing part FT of film F is tucked underneath the trailing part of package F. This operation is feasible due to the fact that the tucking bar 23 moves into the notch 11 of the roll 5.

The tucking bar 23 is movable at a velocity substantially in excess of the right to left movement of package P2 so that the bar 23 moves out of the notch 11 in roll 5 and into the notch 25 in roll 6. Notch 25 is constructed with a greater peripheral span than is the notch 11 and roll 6 is provided with an unnotched peripheral part 26 which is of the same diameter as the unnotched peripheral part 10 of roll 5. Also it is apparent from the drawing that the notched portion 25 of the roll 6 is angularly displaced in a clockwise direction from the notch 11 in roll 5. Since all of the rolls 5-9 rotate in synchronism and at the same speed, the tucking bar 23 conveniently and easily moves out of the notch 11 in roll 5 and into the notch 25 in roll 6. The package P2 is supported in part by the unnotched peripheral part 26 of roll 6 as is apparent from the drawing.

In similar fashion roll 7 is provided with a notched part 27 and with an unnotched peripheral part 28 the radii of these notched and unnotched parts are equal to the radii of the notched and unnotched parts of rolls 5 and 6 and the notched part 27 of roll 7 is angularly displaced in a clockwise direction relative to notch 25 of roll 6 as is obvious from the drawing and the unnotched part 27 of roll 7 includes a wider peripheral span than does notch 25 in roll 6.

In similar fashion roll 8 includes a notched portion 29 and an unnotched portion 30 and the notched portion 29 of roll 8 requires a larger peripheral span than does the notched portion 27 of roll 7. Furthermore the notched portion 29 of roll 8 is angularly displaced in a clockwise direction from the notch 27 in roll 7.

Similarly roll 9 includes a notched peripheral portion 31 and an unnotched peripheral portion 32. From the drawing it is apparent that the notched portion 31 of roll 9 extends approximately half way around the periphery of the roll 9 and thus is larger than the peripheral distance of notched portion 29 of roll 8. Also the notched portion 31 of roll 9 is angularly displaced in a clockwise direction relative to the notched portion 29 of roll 8.

From the description thus far it is apparent that the tucking bar 11 moves in sequence through the notches 11, 25, 27, 29, and 31 and in so doing tucks the trailing part FT of the film F underneath the trailing part of package P2. Furthermore it is apparent from the drawing that when fully tucked, the trailing part FT is disposed in overlying relation with respect to the leading part FL of film F.

Since the tucking bar 11 moves at a substantially higher velocity than does the package P2, the bar simply sweeps underneath the package and moves ahead of package P2 and upwardly on chains 24 so that when package P2 arrives at the position designated at P1, the tucking bar 23 is disposed out of the way and in clearing relation and at a level above the position P1.

As shown in the drawing, package P2 is supported by the unnotched portions such as 10, 26, 28, 30, and 32 of the rolls 5–9 inclusive. As the package P2 moves toward the left to occupy a position intermediate that indicated at P1 and P2, the leading corner 32 of package P2 is lowered due to its own weight into engagement with the unnotched portion 31 of roll 9. As the package moves to the left it is then conveyed by the working reach 17 of conveyor 19 since the notched portion such as 31 of roll 9 is disposed at approximately the same level as the working reach 17. Furthermore it is apparent that the packages such as P1 and P2 must be sufficiently wide relative to the horizontal space between the two spaced apart portions of rolls 5–9 respectively so that the package when disposed at the position P2 is disposed above the working reach 17 of conveyor 19 thus to provide a clearance space for the tucking bar 23 to move forwardly underneath package P2.

From the above description it is apparent that the rolls 5–9 rotate at the same velocity and in synchronoism with each other. This movement may be imparted by the conveyor 19 which if desired can take the form of a pair of transversely spaced chains which in turn can engage sprockets (not shown) on the shafts 5S–9S inclusive.

Once the package is complete as indicated at P1, it is then fed out of the outfeed end of the machine and onto any suitable structure such as schematically represented rolls 34, 35, and 36.

After the package is completely wrapped as indicated at P1, the overlapping leading parts FL and trailing parts FT are secured together by any suitable means such as by electrostatic means or by heat seal or by other known means and the near side and the far side of the package may be closed by suitable folding mechanism as is well known.

INDUSTRIAL APPLICABILITY

The invention is particularly well adapted for wrapping cube shaped packages of random size at high speed with a film overwrap such as may be formed of polyethylene or the like.

I claim:

1. A machine for tucking underneath the trailing part of a moving package the trailing part (FT) of a film arranged in overlying partially enveloping relation to the package, said machine comprising a plurality of notched rollers (5–9) arranged for rotation about horizontal axes (55–95) respectively spaced apart in the direction of movement of the package for supporting and moving the package, the notches (11, 25, 27, 29, 31) in said rollers being angularly displaced in sequence relative to each other, means (19) for rotating said rollers in synchronism with each other, and a film tucking bar (23) movable into engagement with the trailing part (FT) of said film and into said notches in sequence so as to tuck said trailing part of said film underneath the trailing part of the package.

2. A machine according to claim 1 wherein each of said rollers comprises a pair of spaced coaxial parts and wherein a conveyor (19) is interposed between the parts of each of said rollers.

3. A machine according to claim 2 wherein said conveyor (19) includes a working reach (17) and a return reach (19) and wherein the unnotched peripheral parts (10, 26, 28, 30, 32) of said rollers inscribe paths the upper parts of which are at a level above the working reach of said conveyor.

4. A machine according to claim 1 wherein the velocity of movement of the package is dependent upon the tangential velocity of the outer peripheries of the unnotched portions (10, 26, 28, 30, 32) of said rollers.

5. A machine according to claim 1 wherein the velocity of movement of said film tucking bar (23) is substantially in excess of the velocity of movement of the package.

6. A machine according to claim 1 wherein the peripheral dimensions of the notches (11, 25, 27, 29, 31) in said rollers (5–9) are sequentially greater in the direction of movement of the package.

7. A machine according to claim 2 wherein said conveyor (19) includes a working reach (17) and a return reach (18) and wherein the peripheries of the notched parts (11, 25, 27, 29, 30) of said rollers inscribe paths the upper parts of which are at substantially the same level as the working reach of said conveyor.

8. A machine according to claim 2 wherein said conveyor (19) is mounted on an outfeed (16) and an infeed roll (15) the radii of which are substantially the same as the radii of the notched portions of said rollers.

9. A machine according to claim 1 wherein the leading part (FL) of the film (F) is disposed underneath the leading part of the moving package and wherein said film tucking bar (23) is arranged to move the trailing part (FT) of the film into overlapping relation with the leading part (FL) of the film.

10. A machine according to claim 1 wherein said tucking bar (23) is arranged to move underneath and forwardly in front of the package following completion of a film tucking operation on the trailing part (FT) of the film.

* * * * *